US007337736B2

(12) United States Patent
Kennedy

(10) Patent No.: US 7,337,736 B2
(45) Date of Patent: Mar. 4, 2008

(54) DOUBLE HULLS

(75) Inventor: Stephen John Kennedy, Ottawa (CA)

(73) Assignee: Intelligent Engineering (Bahamas) Limited, Nassau (BM)

( * ) Notice: Subject to any disclaimer, the term of this patent is extended or adjusted under 35 U.S.C. 154(b) by 47 days.

(21) Appl. No.: 10/515,961

(22) PCT Filed: May 30, 2003

(86) PCT No.: PCT/GB03/02389

§ 371 (c)(1),
(2), (4) Date: Jun. 10, 2005

(87) PCT Pub. No.: WO03/101821

PCT Pub. Date: Dec. 11, 2003

(65) Prior Publication Data

US 2005/0229832 A1 Oct. 20, 2005

(30) Foreign Application Priority Data

May 31, 2002 (GB) ..... 0212750.4

(51) Int. Cl.
*B63B 25/08* (2006.01)

(52) U.S. Cl. ..... 114/74 T

(58) Field of Classification Search ..... 114/74 T
See application file for complete search history.

(56) References Cited

U.S. PATENT DOCUMENTS 5,778,813 A 7/1998 Kennedy
6,050,208 A * 4/2000 Kennedy ..... 114/74 A
2001/0035266 A1 11/2001 Kennedy

FOREIGN PATENT DOCUMENTS

GB 2 143 184 A 2/1985
GB 2 337 022 A 11/1999
GB 2 380 970 A 4/2003

OTHER PUBLICATIONS

Taggart, Robert; "Ship Design and Construction", 1980, SNAME, New York, pp. 218-223, XP-002254589.

"Double-Skins in Bulk"; Marine Engineers Review, Institute of Marine Engineers, London, Great Britan, Jun. 1999, pp. 21, 23, XP000850896.

* cited by examiner

*Primary Examiner*—Stephen Avila
(74) *Attorney, Agent, or Firm*—Darby & Darby

(57) ABSTRACT

Barge double hull sections wherein at least part of the double hull is comprised of first and second layers and an intermediate layer of elastomer material bonded to the first and second layers. By manufacturing double hull walls of such three layered structures, the stiffness of the hull as compared to hulls of the prior art can be significantly increased, thereby decreasing the amount of separate stiffeners required in the hull structure.

25 Claims, 15 Drawing Sheets

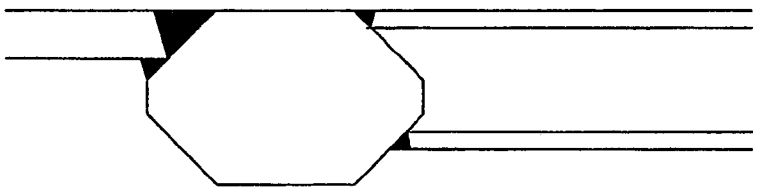
Fig. 14
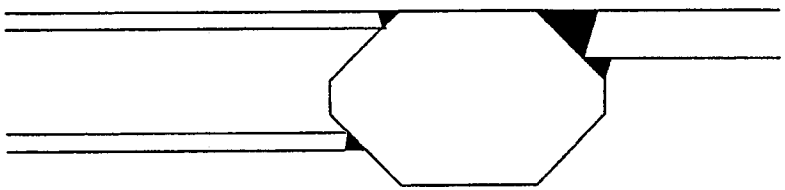

DOUBLE HULLS

CROSS-REFERENCE TO PRIOR APPLICATIONS

This is a U.S. national phase application under 35 U.S.C. §371 of International Patent Application No. PCT/GB03/02389 filed May 30, 2003, and claims the benefit of UK Patent Application No. 0212750.4 filed May 31, 2002 which is incorporated by reference herein in its entirety. The International Application was published in English on Dec. 11, 2003 as WO 03/101821 A1 under PCT Article 21(2).

FIELD OF THE INVENTION

The present invention relates to hulls and more particularly to hulls of barges, barge hull sections and hulls of boats designed for haulage of bulk cargo (e.g. coal, iron ore, rock, etc). The present invention further relates to methods for joining hull sections to form a complete hull.

BACKGROUND OF THE INVENTION

A hull section typical of the prior art "all steel" river barges is shown in FIG. 1 of the accompanying drawings. The hull section has a double hull wall construction in which inner hull walls 100 define an inner side shell and a bottom of a hold 5 and outer hull walls 110 define an outer side shell and a bottom i.e. the shape of the outer hull. Both inner and outer walls are made of 8 to 15 mm thick steel plates. As can be seen in FIG. 1, a plurality of (floor) transverse girders 120 are positioned approximately 600 mm apart between the bottom inner hull walls 100 and the bottom the outer hull walls 110. A large number of transverse girders 120 are required because of the relative flexibility of the steel plates of the hull walls 100, 110. The cavity (inner space) within the side shell structure (i.e. the side shells of the inner and outer hull walls 100, 110) contains a plurality of channel beams 130 and columns 140 to provide the required stiffness.

"All steel" river barges such as that illustrated in FIG. 1 are relatively complex structures with a large number of transverse girders 120, cavity stiffening elements 130,140 and bulb flat or angle plate stiffeners 115, all required to stiffen and strengthen the plating and hull structure for the design loads.

SUMMARY OF THE INVENTION

The present invention provides a hull section with an outer hull and an inner hold comprising:

inner hull plating comprising an inner bottom defining a bottom of said hold and a lower inner side shell defining lower sides of said hold;

outer hull plating comprising an outer bottom defining a bottom of said outer hull and a lower outer side shell defining lower sides of said outer hull; and a plurality of transverse girders located, in a spaced apart relationship, transversely between the inner and outer bottoms, each of said plurality of transverse girders having two associated web frames located at each end of said transverse girders and between said lower side shells;

wherein said inner hull plating and said outer hull plating are each comprised of a first metal layer and a second layer and an intermediate layer of elastomer bonded to said first and second layers so as to transfer shear forces there between.

The cross-sectional shape and construction can be varied to include a hopper to ease flow of dry cargo towards the centre of the hold or any combination of features to optimise the functionality for a given trade route and cargo.

A hull section constructed in this way can be up to 10% lighter and provide 10% more volume than a hull section of similar size manufactured according to the prior art. The number of transverse girders, web frames and stiffeners required to be welded in the structure is fewer, thereby reducing the number, size and volume of welds, simplifying fabrication, reducing man hours for fabrication and shortening build time. The hull section can advantageously be built with prefabricated "Sandwich Plate System" (SPS) panels which are simply welded together with framing members (traverse and longitudinal girders and web frames) in the shipyard; "a kit ship". Prefabricated panels are of excellent quality and have tight dimensional tolerances, within the range of a few millimeters.

Preferably the hull section further comprises inner and outer upper side shells attached opposite said bottom hull wall to said inner and outer lower side shells respectively. Also a hull section wherein said web frames extend between said inner and outer upper side shells and said upper side shells are comprised of a first metal layer and a second metal layer and an intermediate layer of elastomer bonded to said first and second layers so as to transfer shear forces there between. In this way the volume of the cargo hold can be increased yet further.

The present invention further provides a hull section with an outer hull and an inner hold; comprising:

a bottom defining on a first side at least a part of the bottom of said outer hull and, on a second side, the bottom of said inner hold;

inner side shells defining side walls of said inner hold;

bottom outer side shells defining side walls of said outer hull and parts of the bottom of the outer hull not defined by said bottom hull wall; wherein said bottom is comprised of a first layer, a second layer and an intermediate layer of elastomer bonded to said first and second layers so as to transfer shear forces there between.

Such a hull section is considerably lighter than the "all steel" hull sections of the prior art, is simpler to assemble and provides the possibility of providing a hold with a more useful shape.

The use of a so called 'sandwich Plate System' (SPS) (i.e. the first, second and intermediate layers) allows a part of the bottom of the hull to be constructed of a single skin because of the inherent stiffness and impact resistance of SPS. Further advantages of the use of SPS are simplified construction and increased volume of hold for a given outer volume of barge.

Further details of SPS structures suitable for use in the present invention can be found in U.S. Pat. No. 5,778,813, incorporated herein by reference and British Patent Application GB-A-2 337 022, incorporated herein by reference. The intermediate layer may also be a composite core as described in British Patent Application No. 9926333.7, incorporated herein by reference.

BRIEF DESCRIPTION OF THE DRAWINGS

The present invention will be described further below with reference to the following description of exemplary embodiments and the accompanying schematic drawings, in which:

FIG. 14 is a SPS panel to steel plate connection;

DETAILED DESCRIPTION

In the figures like references designate like parts.

Figure 2:
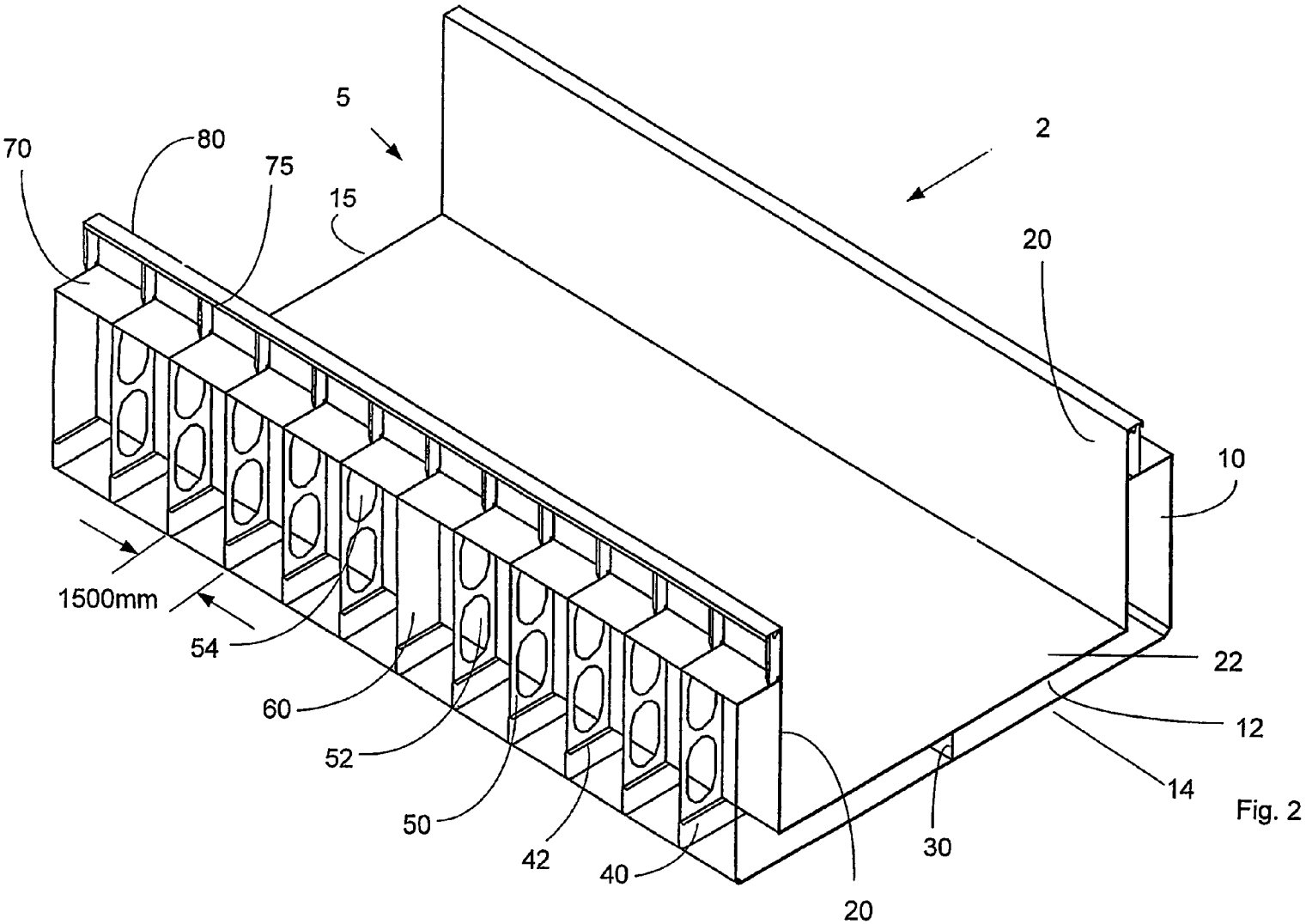
FIG. 2 is a schematic projection cut-away view of a hull section according to a first embodiment of the present invention.

FIG. 2 shows a barge hull section 2 according to a first embodiment of the present invention. The outside of the hull is defined by outer hull walls 10, 12. The outer hull walls include outer bottom plating 12 and side shell plating 10.

The hull section 2 includes a hold 5 into which cargo may be placed for transport. The hold 5 is defined by side inner shell plating 20 (upper and lower sides combined) and an inner bottom (tank top) 22.

The inner and outer hulls are both made of so called "sandwich plate system" SPS plating which is made continuous by welding. Such SPS structures are made of a first layer and a second layer with an intermediate layer of elastomer bonded between the first and second layers.

Preferably, the first and second layers are made of metal, such as steel, stainless steel or aluminium. SPS structures are stiffer and lighter in weight than stiffened steel panels of comparable strength.

A plurality of (floor) transverse girders 40 are attached (welded) between the outer bottom 12 and the inner bottom 22 substantially across the entire beam of the hull. The distance between the girders is at least 1000 mm, preferably 1250 mm and more preferably (as is illustrated) at least 1500 mm though could be as much as 2400 mm or even more.

At both ends of each of the plurality of transverse girders 40, a web frame plate member 50 is attached (welded) which is located between and substantially perpendicular to the inner side shell 20 and the outer side shell 10. Most of the web frame members 50 have a lower cut-out 52 and an upper cut-out 54 to reduce weight without significantly reducing the stiffness of the hull 2 and to allow access to the side shell structure. Some of the web frame members 50 are solid (i.e. do not have cut-outs) to form watertight bulk heads 60. If required, landing plates 42 may also be attached to the (floor) transverse girders 40 in order to further stiffen the structure and to provide a landing surface to which the side shell web frames 50 are welded.

A longitudinal girder 30 positioned between the outer bottom 12 and the inner bottom 22 substantially halfway across the beam of the hull, extends along the longitudinal length of the hull section 2 from a first end 14 to a second end 15. More than one longitudinal girder 30 may be incorporated into the double bottom structure.

Figure 1:
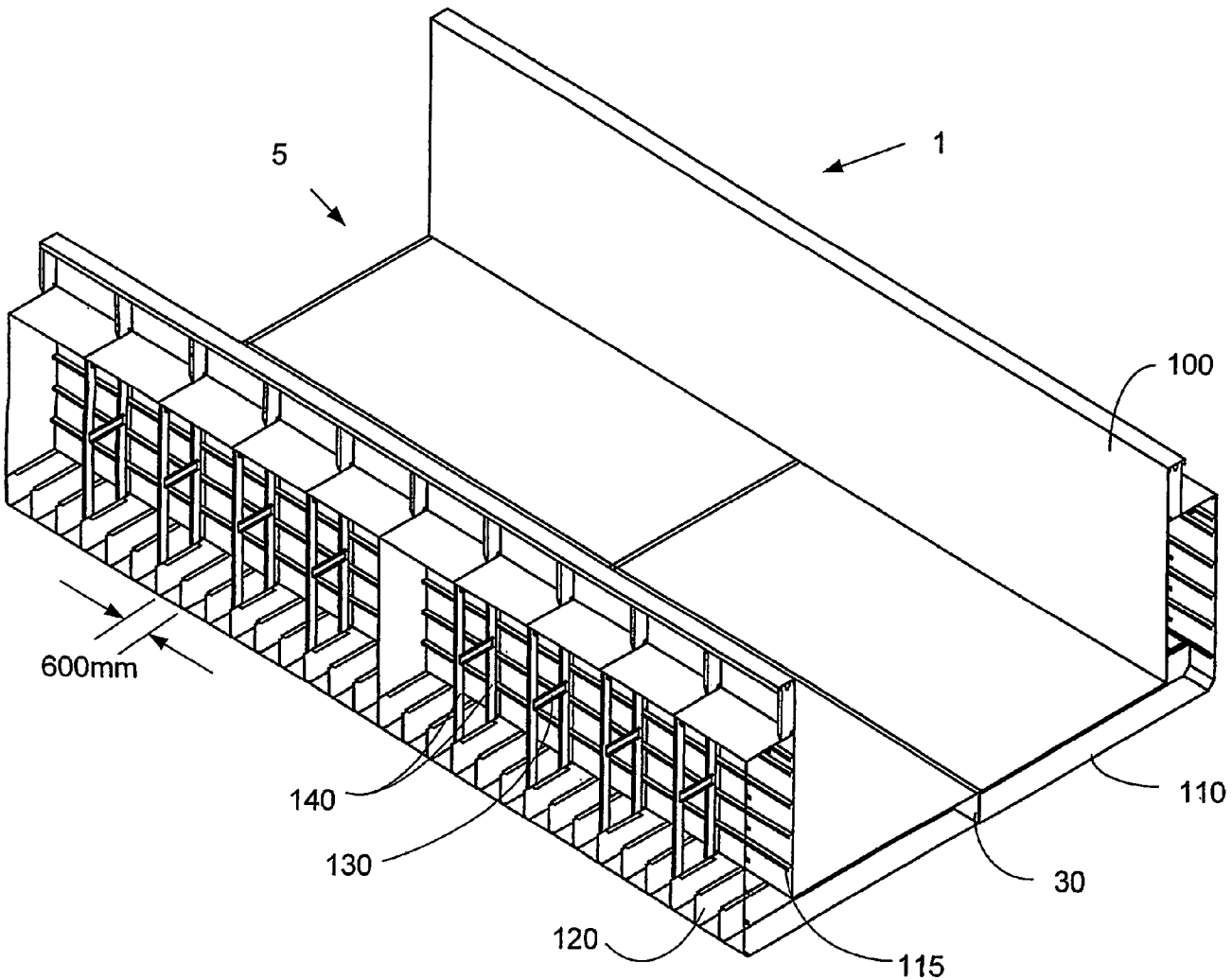
FIG. 1 is a schematic projection cut-away view of a hull section of a double skinned "all steel" barge of the prior art.

The stiffening structure comprising the longitudinal and transverse girders 30, 40, and the web frame plate members 50, 60 is significantly lighter than the equivalent stiffening structure required in traditional "all steel" barges such as the one illustrated in FIG. 1.

Typically, the outer bottom 12 and outer side shell 10 will be comprised of first and second steel layers 4 mm thick, with an intermediate layer of elastomer 25 mm thick. The elastomer is bonded to the first, and second layers. Preferably, the intermediate layer is bonded to the first and second layers so as to transfer shear forces there between.

Preferably, the inner side shell 20 is comprised of first and second layers of steel 5 mm thick, and an intermediate layer of 25 mm. The inner bottom (tank top) 22 is preferably comprised of a first layer, defining the hold, of steel 6 mm thick, followed by the intermediate layer of 30 mm thickness and a second layer of steel, positioned closest to the outer hull, with a thickness of 4 mm. The first layer may be comprised of a (tough) wear resistant material or have a wear resistant coating to resist wear and gouging by grabs.

In the embodiment illustrated in FIG. 2, the hull sections are 18000 mm long. The dimensions of the hold is 9000 mm in beam, and 4450 mm high. The hull has an overall beam of 11330 mm.

The longitudinal girder 30 is typically made of steel 8 mm in thickness and 650 mm in height. The transverse girders 40 also have a height of 650 mm but are only 6 mm thick. That is the same thickness as the web frame plate members 50 which have approximate dimensions of 1115 mm by 3350 mm.

In the embodiment illustrated in FIG. 2, sheerstrake plates 70 are attached between the tops of web frames 50 opposite the transverse (floor) girders 40 to form a sheerstrake. Those plates may also be made of a SPS plating, for example, with a first and second layers of steel of 4 mm thickness and an intermediate layer of 25 mm thickness. The sheerstrake plates 70 are attached at the top of the (outer) side shell 10 which are 450 mm below the level of the inner side shell 20. Attached to the top of the inner side shell 20 above the sheerstrake 70 is a gunwale channel 80 which is supported by a plurality of gunwale stiffeners 75 attached to the outside of the side inner hull walls 20. In an alternative embodiment, in order that the channel between the inner and outer hull is reduced in thickness, thereby increasing the size of the hold 5 for given hull dimensions, the gunwale channel 80 may overhang the hold 5 rather than the sheerstrake plates 70. In that embodiment the gunwale stiffeners 75 are attached on the outside surface of the inner side shell 20.

The dimensions given are illustrative only and will vary from barge to barge. For large barges, the dimensions may be significantly larger.

Examples of methods which may be used for assembling the hull section 2 as illustrated in FIG. 2, are given below with reference to FIGS. 8 to 17 as are examples of how several hull sections may be joined end 14, 15 to end 14, 15 to form a complete barge hull.

Figure 3:
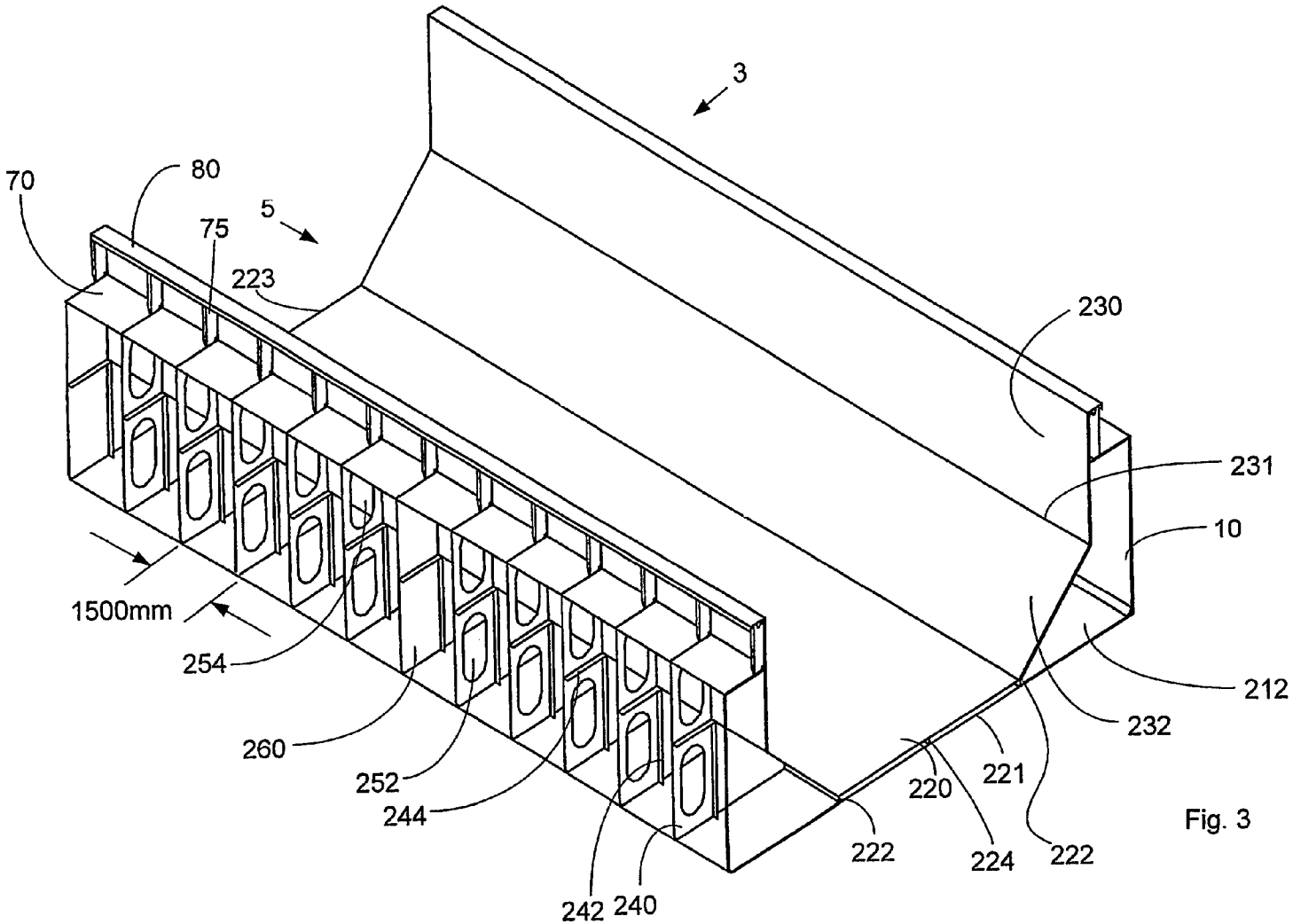
FIG. 3 is a schematic projection cut-away view of a hull section according to a second embodiment of the present invention.

FIG. 3 illustrates a second embodiment of a hull section 3 according to the present invention. The hull section 3 comprises a bottom hull 220 defining both the bottom of a hold 5 and the bottom of the outside of the hull. The bottom hull 220 is comprised of a first layer, a second layer and an intermediate layer of elastomer bonded to the first and second layers. The intermediate layer may be constructed with a composite core (elastomer and a low density material) as described in GB 2 355 957 the disclosure of which is hereby incorporated by reference. Preferably, the first layer of the bottom hull wall, defining the inside of the hold 5, is made of steel and is 10 mm thick. The intermediate layer of the bottom hull wall 220 is preferably at least 150 mm thick, more preferably at least 250 mm thick and the second layer of the bottom hull, defining the outside of the hull, is preferably 8 mm thick. A longitudinal girder 224 between the first and second layers of the bottom hull wall 220 is approximately 16 mm thick and the same height as the thickness of the intermediate layer. In the example illustrated in FIG. 3, the height is 150 mm.

The remainder of the outer of the bottom of the hull is comprised of two bottom outer side shells 10,210 which define not only the outer sides of the hull but also the parts of the bottom not defined by the bottom plating 220. The bottom outer side shells are joined to opposite sides of the bottom hull wall 220 at longitudinal edges 222. Alternatively, the bottom plate 221 of the bottom hull 220 may extend outward to the edge of the bottom and be connected to the rest of the outer side shell there. The bottom outer side shells 10,210 are preferably made of SPS planting as is the bottom hull 220 in the embodiment in which it extends to the edge of the bottom of the hull.

In the embodiment illustrated in FIG. 3, the width (i.e. the beam) of the bottom hull wall 220 is 5000 mm and the width (i.e. beam) of both bottom outer hull walls 212 is 3165 mm such that the overall beam of the hull is 11330 mm.

The hold is defined on the bottom by the bottom hull wall 220 and on the sides by inner side shells 230, 232. The inner side shells comprise two top inner side shells 230 on each side and generally perpendicular to the bottom hull wall 220 and two hoppers 232 connected between the longitudindal edges 222 of the bottom hull 220 and bottom longitudinal edges 231 of the top inner side shells 230. By adjusting the relative sizes of the inner side shells and hoppers 230, 232, and the bottom hull 220, the shape and volume of the hold 5 can be changed.

The inner side shell and hopper sides 230, 232 are preferably also made of SPS plating. The hopper sides 232 are preferably made of a first layer defining the inside of the hold 5, of steel of a thickness of 8 mm, an intermediate layer of 30 mm thick and a second layer of steel 4 mm thick. The inner side shell 230 is preferably comprised of first and second layers of steel 4 mm thick and an intermediate layer of 25 mm thick. In the illustrated embodiment, the side outer hull walls are 4000 mm high, the width of the bottom hull inner side wall is 2828 mm and makes an angle of 45 degrees to the bottom outer hull walls 212. The height of the top inner hull side wall 230 is 2990 mm. The shape of the hold 5 depicted in FIG. 3 is particularly advantageous for forming a hopper for granular material. Preferably the hopper has an angle of repose (i.e. angle to the bottom hull) of less than 45°, preferably 30°. This is the angle at which material will naturally slide.

A plurality of web frames 240 are attached in the side shell structure between and perpendicular to the inner side shell 230 and hopper 232 and outer side shell 10. The web frames 240 are dimensioned to be in full contact with the surfaces of the inner side shell 230 and hopper 232, the outer bottom 212 and the bottom outer side shell 10. The web frames also substantially extend to the longitudinal edges 222 of the bottom hull 220. The plurality of web frames 240 are in spaced apart relationship along the longitudinal length of the hull section. Preferably, the web frame plate members 240 are at least 1000 mm apart, preferably 1250 mm apart and more preferably 1500 mm apart but can be as large at 2400 mm. In the embodiment illustrated in FIG. 3, the web frames 240 are 8 mm thick.

If the stiffness provided by the web frame plate members 240 alone is not enough, vertical web frame stiffeners 242 and horizontal web frame stiffeners 244 may be attached to the faces of the web frames 240 to increase stiffness and so to prevent local buckling.

To reduce the weight of the hull section, and to provide access lower cut-outs 252 and upper cut-outs 254 may be manufactured into the web frame plate members 240.

The sheerstrake 70 and gunwale 80 arrangement is the same in the second embodiment as in the first embodiment.

Figure 4:
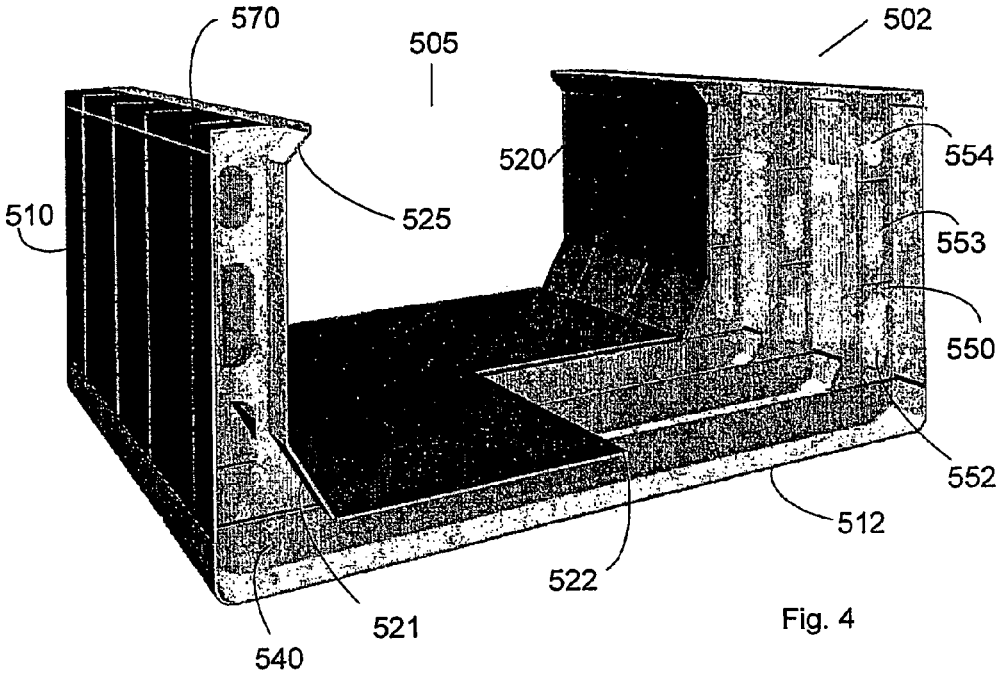
FIG. 4 is a schematic projection cut-away view of a hull section according to a third embodiment of the present invention.

FIG. 4 illustrates a third embodiment of a hull section 502 according to the present invention. The hull section 502 is the same as the hull section 2 according to the first embodiment of the present invention save as described below. The general construction of the outer bottom and side shell 512, 510, the transverse (floor) girders 540, the web frames 550 with lower, mid and upper cut outs 552, 553, 554 is the same as that of the first embodiment. The difference is in the construction of the inner side shell which comprises and upper inner shell 520 and a hopper side 521 and also in the construction of the sheerstrake/gunwale.

In the hull section 502 of the third embodiment the lower inner side shell is formed as a hopper side 521 to reduce unloading time for cargos. The hopper side 521 is the lower part of the inner side shell and increases the angle of intersection of the side inner hull wall with the bottom inner hull wall 522 to between 110° to 135°. In this way cargos in the hull section 502 are concentrated towards the centre of the inner bottom 522 by the action of gravity thereby reducing the unloading time for cargo.

The hopper side 521 is attached to web frames 550 which are shaped to contact both the hopper side 521 and the upper inner side 520 thereby to support the SPS plating which comprise the upper inner side shell 520 and hopper side wall 521.

The sheerstrake/gunwale arrangement of the third embodiment are different to that of the first embodiment. The web frames 550 extends all the way to the sheerstrake/gunwale level 570. The upper inner side shell 520 has at its top end a top inner side shell section 525 which is angled in towards the hold 505 of the hull section 502. The web frames 550 are shaped such that the SPS plating of the top inner side shell 525 can be supported by the web frames 550.

The third embodiment allows cargo hold volume to be increased whilst allowing the light weight feature of the barge to be maintained. The top inner side shell which overhangs the cargo hold increases the width of the walkway along the side of the deck of the barge and also provides a degree of protection to the cargo.

Figure 5:
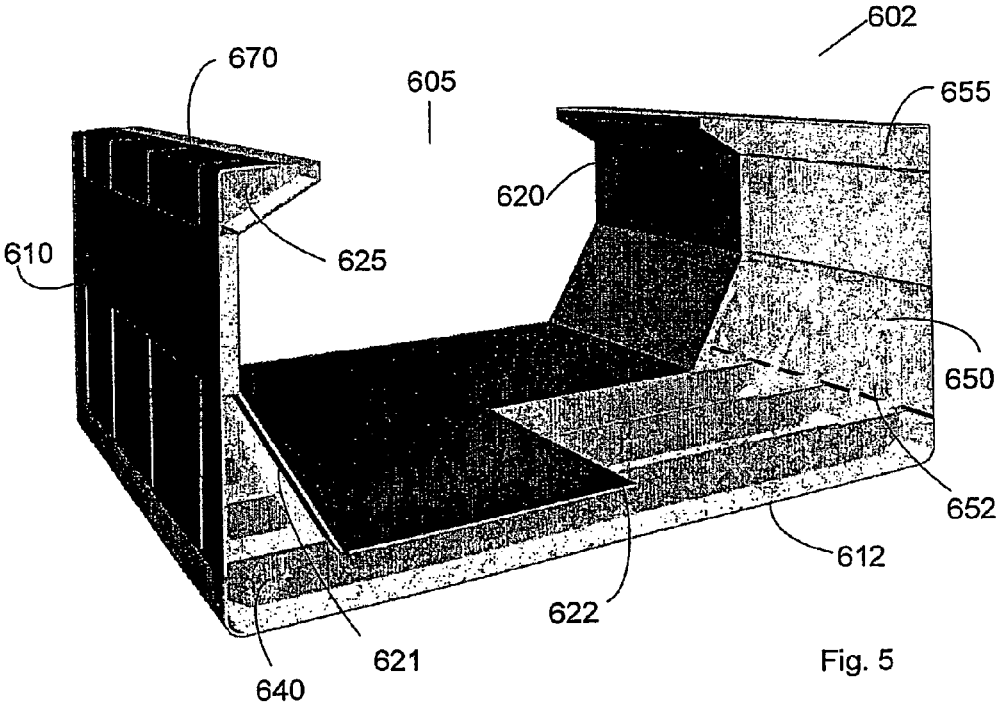
FIG. 5 is a schematic projection cut-away view of a hull section according to a fourth embodiment of the present invention.

FIG. 5 illustrates a fourth embodiment of the present invention which is the same as that of the third embodiment except that the web frame plate member 550 of the third embodiment is now comprised of a lower web frame plate member 650 with a cut out 652 and an upper web frame plate member 655 (which may also have a cut out). Those web frame plate members 650, 655 support the lower side inner hull wall 621 and the upper side inner hull wall 625 respectively. In between the upper and lower web frame plate members 650, 655, there is positioned a length of SPS, the outer side shell 610 being defined by an outer plate of the SPS member and the inner side shell 620 being defined by the inner plate of the SPS member. The SPS is typically made of metal (steel) 5 mm thick with an elastomer layer in between of 200 mm thick. In this way the weight per unit length of hull is reduced at the same time as increasing hold 605 volume. Also, the composite or solid SPS side shell simplifies construction and maximises cargo hold volume for given barge size.

Figure 6:
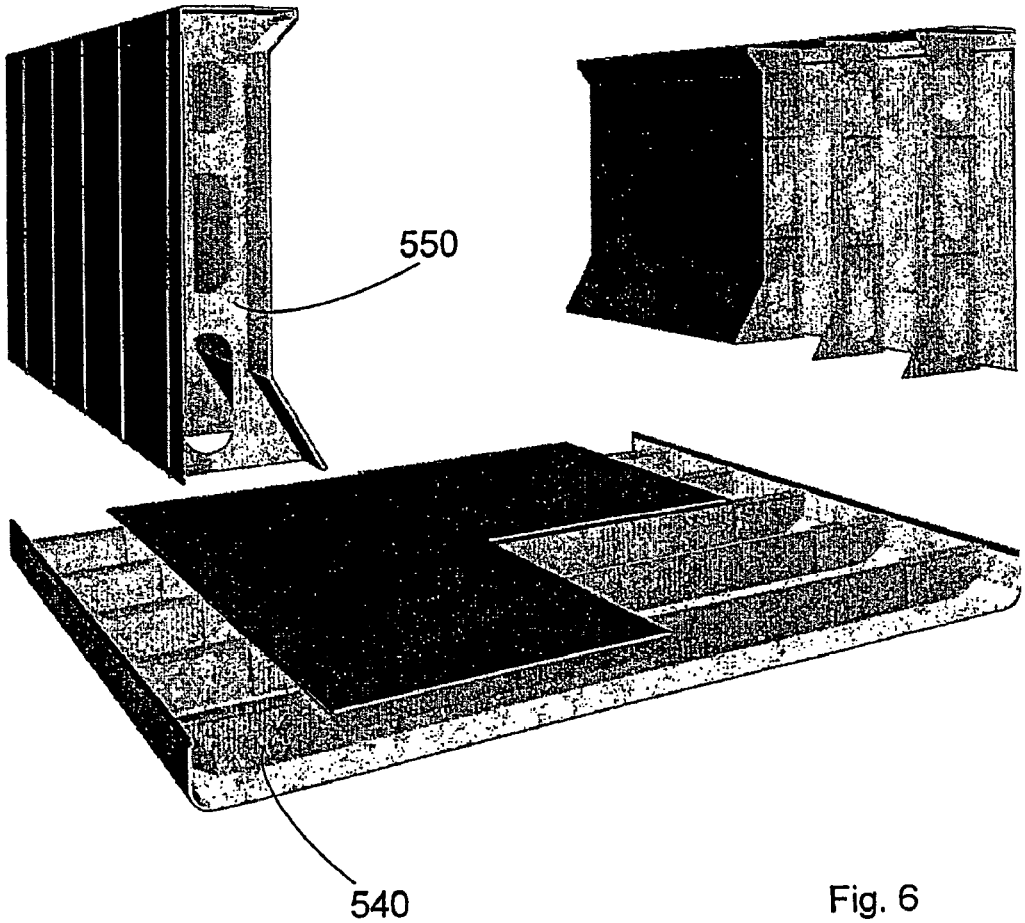
FIG. 6 is a perspective view of a barge hull before the final assembly stage.

FIG. 6 illustrates a preferred method of assembly of a hull section. SPS plating is prefabricated in a controlled environment to ensure dimensional accuracy and quality control and then attached to transverse (floor) girders 540 or the web frames 550 such that three sub assemblies comprising a bottom hull structure and two side shell structures are formed. The final step is to attach those two side shell structures to either side of the bottom hull structure.

Figure 7:
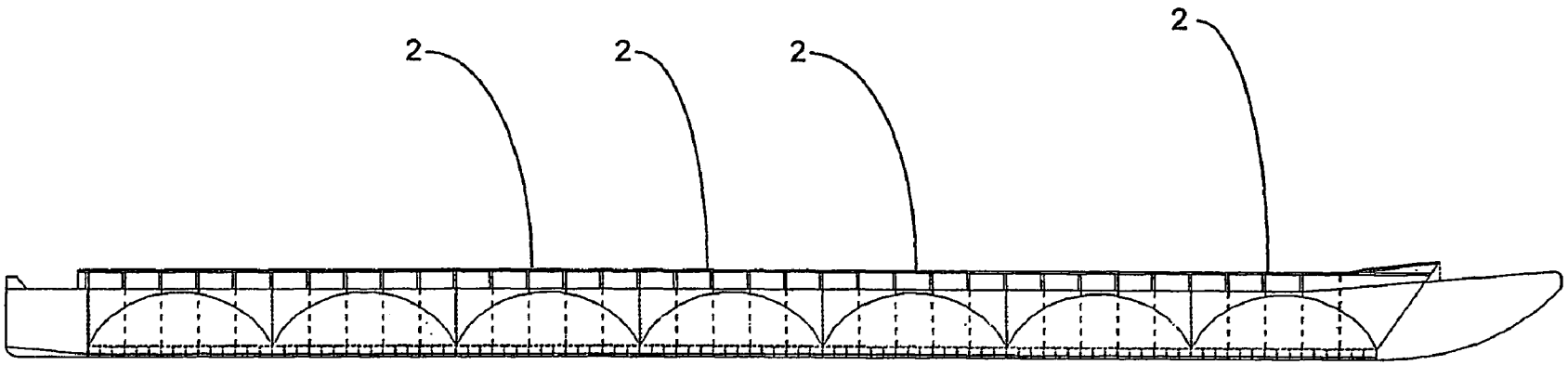
FIG. 7 is a perspective view of a barge hull assembled from a plurality of barge hull sections according to the present invention.

When a plurality of barge hull sections 350, 360 are joined, the hull of a barge can be constructed, as is shown in FIG. 7.

Preferred methods of joining various components of the barge will now be described. It will be clear to the skilled person that there are other ways of joining components.

FIGS. 8 to 12 and 14 show correction details using a so called universal connector 1000, the use of which is described in detail in United Kingdom Patent Application No. 0124734.5 the content of which is hereby incorporated by reference.

The universal connector 1000 comprises an elongate metal body of substantially constant cross-section and having at least one tapered edge formed by first and second inclined surfaces, said inclined surfaces serving as landing surfaces and weld preparations for first and second metal face plates of an SPS member. Preferably the tapered edge is provided with a flared part to enhance bonding to said plastics or polymer core. The body may further comprise a second tapered edge.

Figure 8:
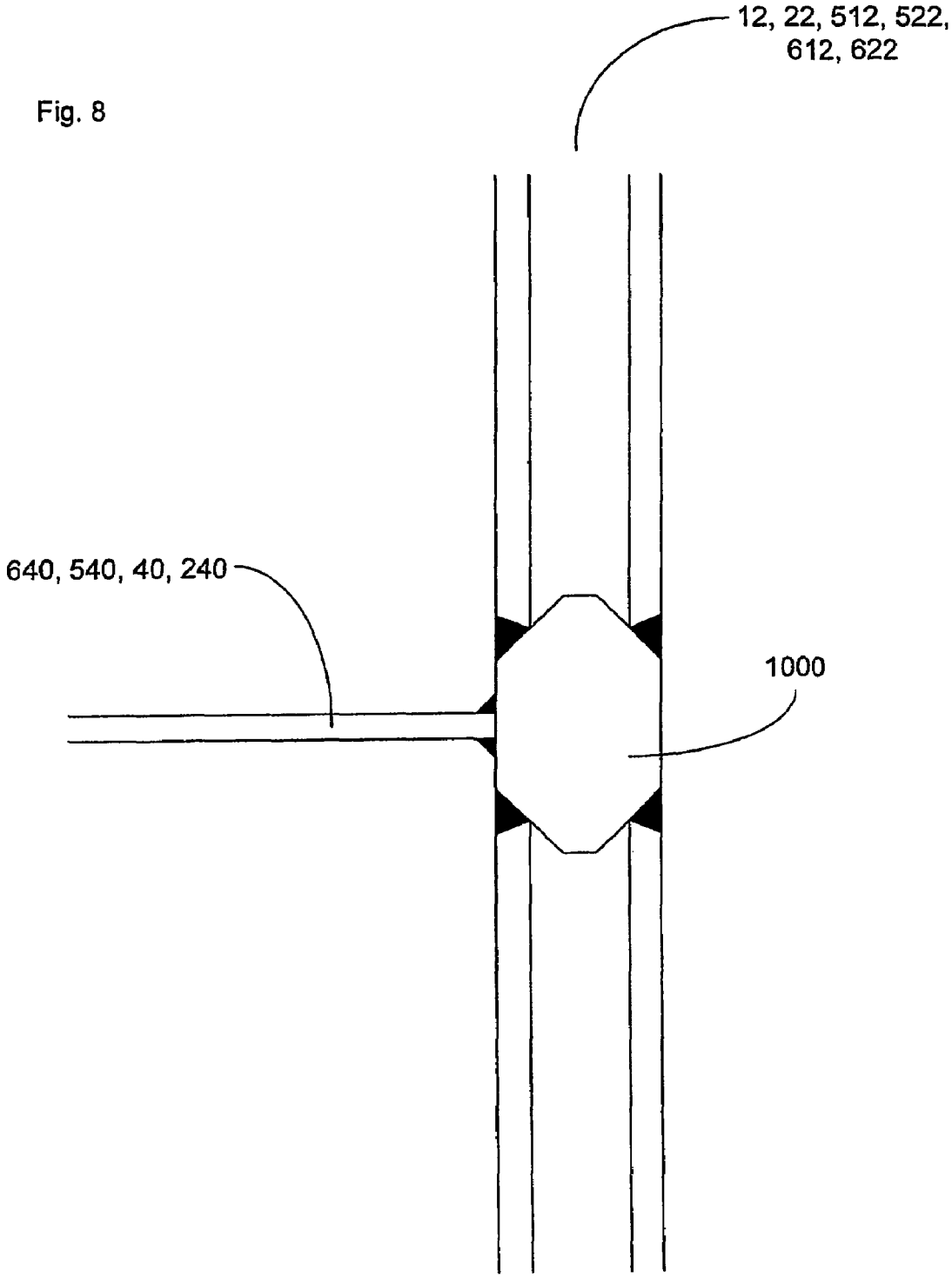
FIG. 8 is a typical web frame to SPS panel connection, transverse floor girder to SPS panel connection, or longitudinal girder to SPS panel connection.

FIG. 8 illustrates a typical joint between two SPS members and a transverse (floor) girder though is applicable elsewhere such as the connection to SPS members of longitudeal girders or web frame plate members. The joint comprises a universal connector 1000 which has tapered edges inserted between outer layers of the SPS member and the transverse girder is attached by welding using finishing welds. The connector 1000 is welded to the outer layers of the SPS member (shop welds). The same joint detail may be used between the longitudinal girder and the SPS members or the transverse web frames and the SPS members.

Shop welds are part of the pre-fabrication process (can be made automatically and be assembled robotically) and finishing welds are made in the field i.e. by the shipyards which are assembling the barge.

Figure 9:
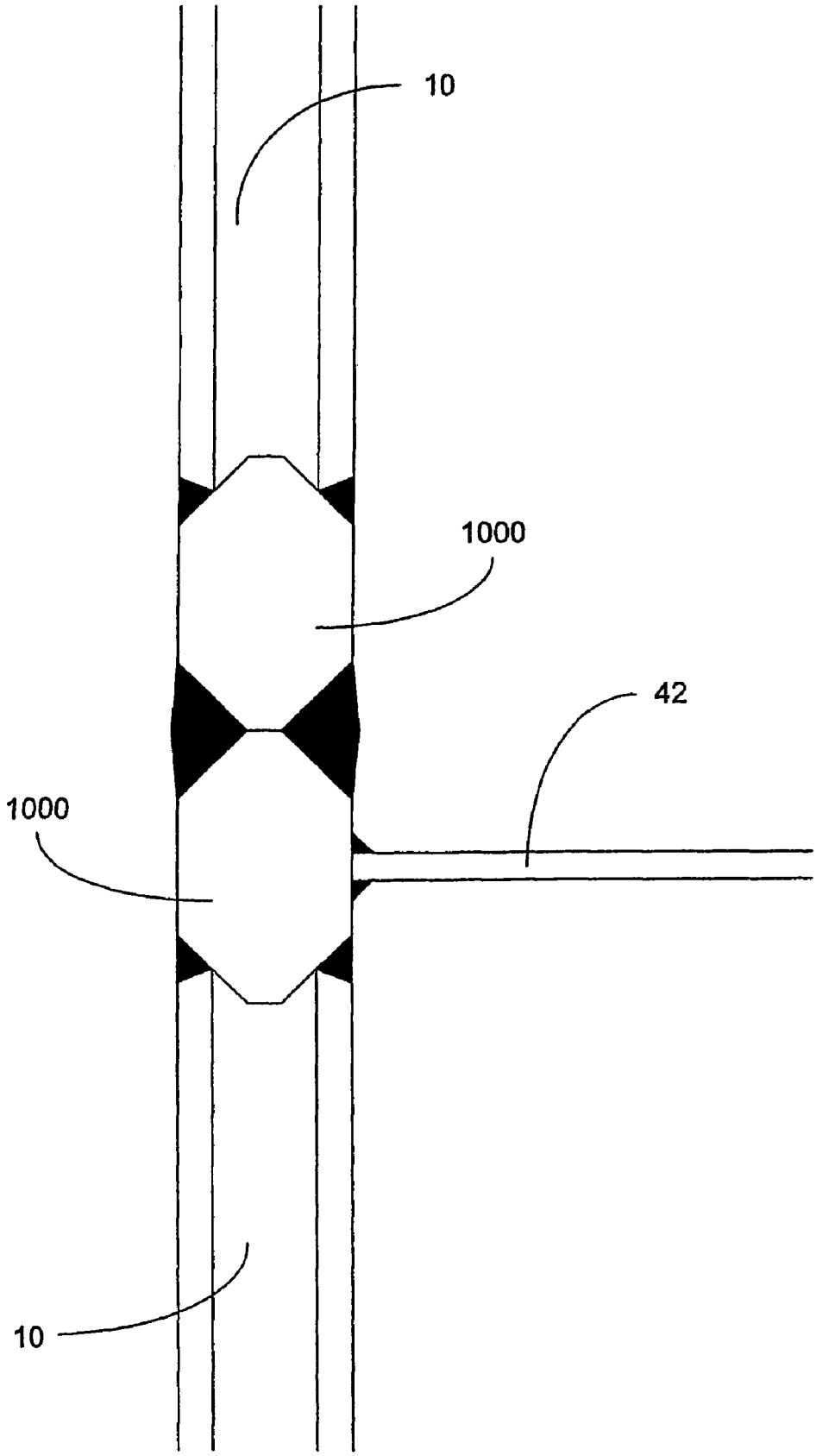
FIG. 9 is an outer side shell bilge connection.

FIG. 9 illustrates a connection detail between the side shell structure and the bottom hull structure of FIG. 6 on the outer side. The edge of each structure is shop prepared using a universal connector and the two structures are joined by finish welding the two universal connectors together.

Figure 10:
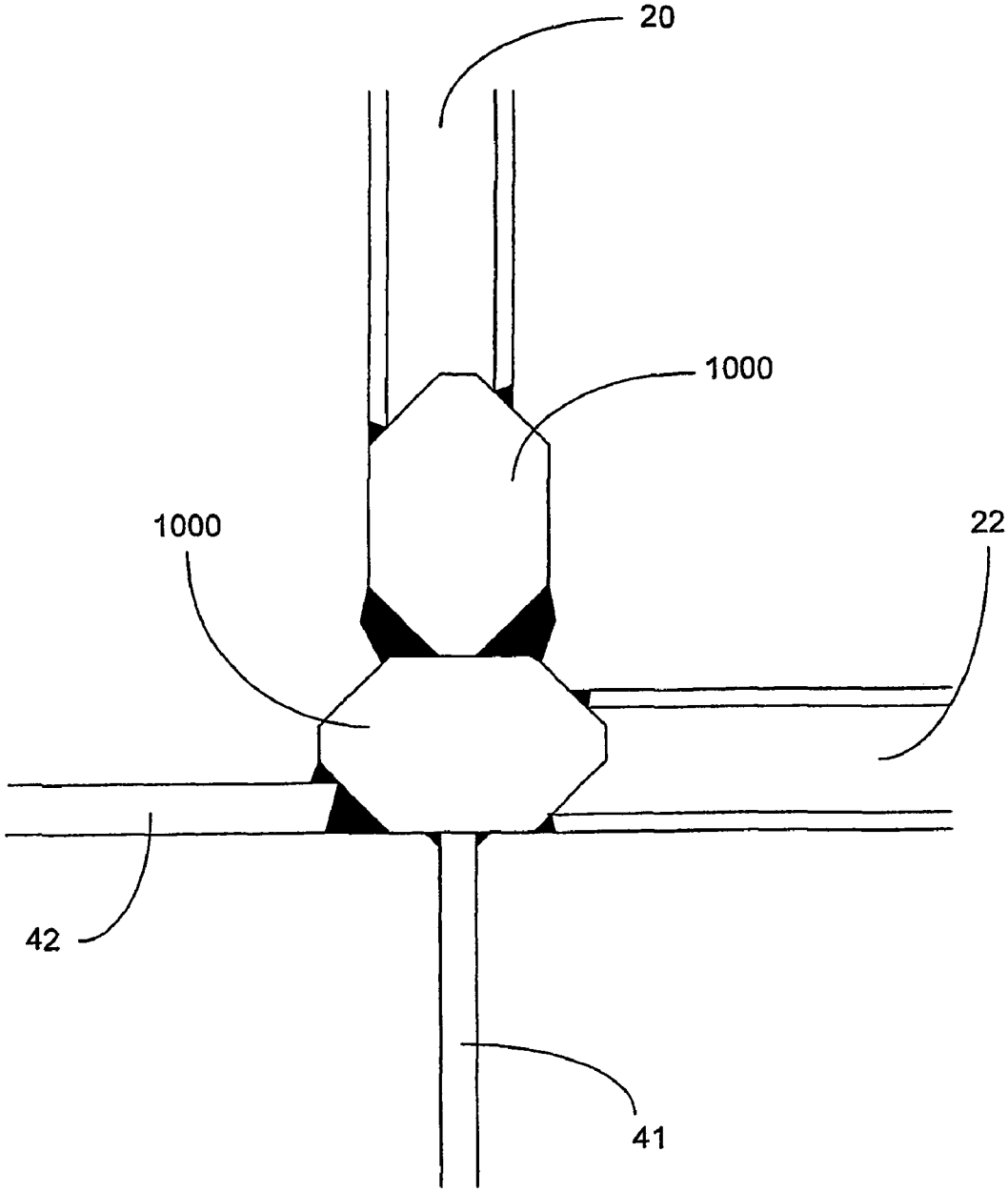
FIG. 10 is an inner side shell inner bottom connection.

FIG. 10 illustrates a connection detail between the side shell structure and bottom hull structure of FIG. 6 on the inside. The lower universal connector 1000 (as illustrated) is attached (welded) to the inner hull bottom 22, landing plates 42 and vertical stiffeners 41 before being welded to the upper universal joint as illustrated which is already attached to the inner side shell 20.

Figure 11:
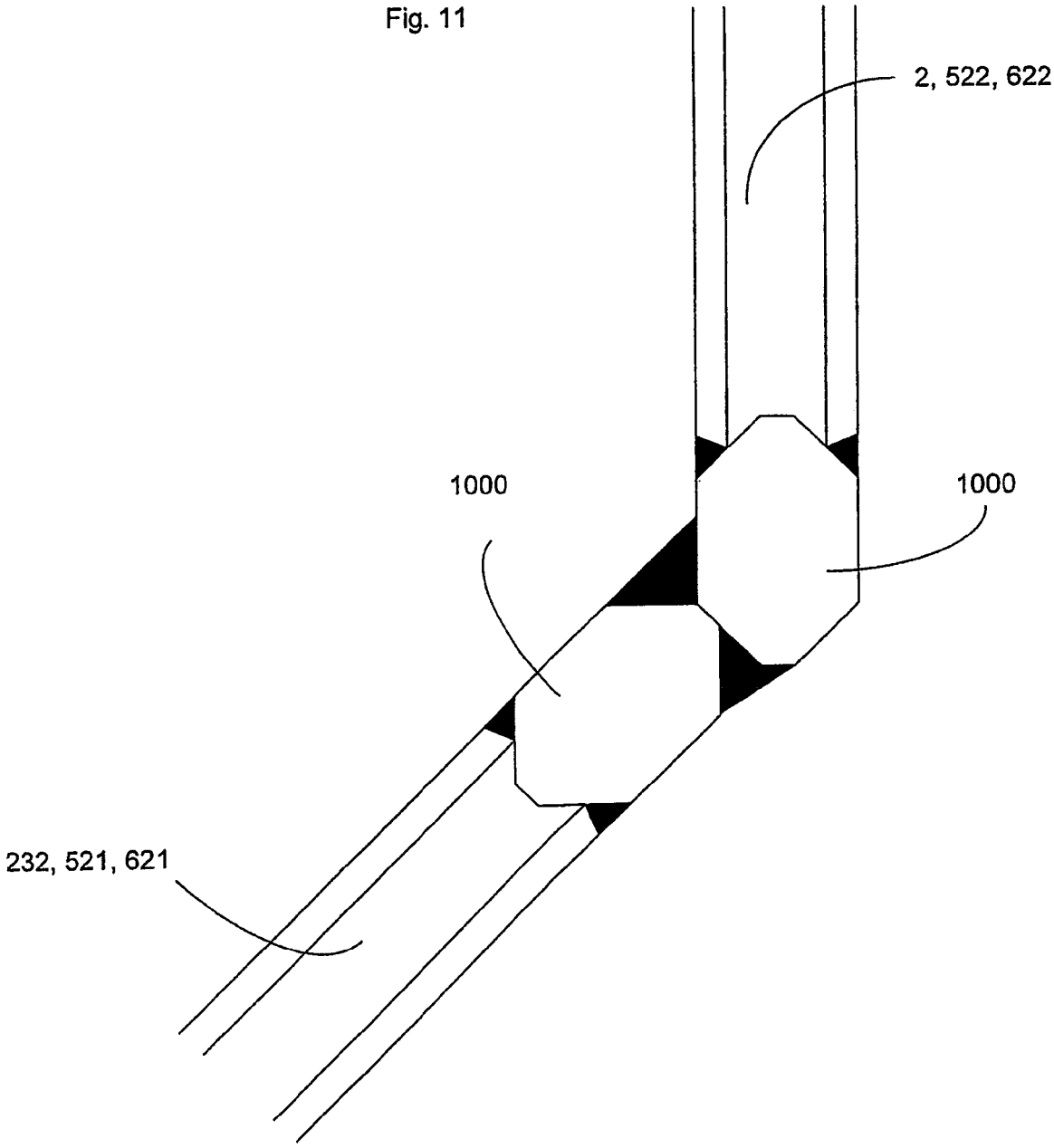
FIG. 11 is a hopper to inner bottom connection.

FIG. 11 illustrates how the bottom edge of the hopper 232,521,621 might be connected to the bottom hull 221, 522,622 in which the welds between the universal connectors are finishing welds and the others are shop welds.

Figure 12:
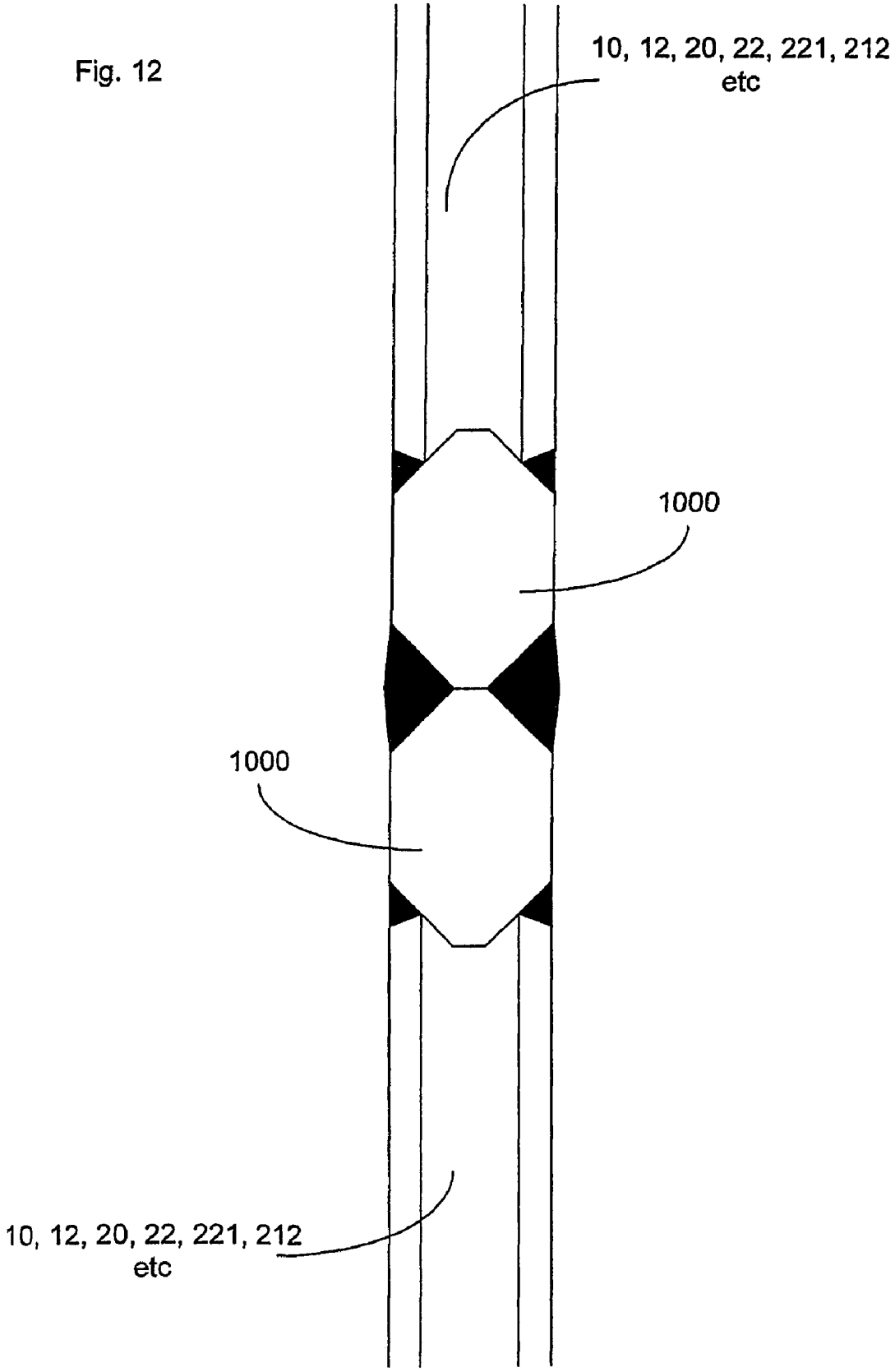
FIG. 12 is a hull module to hull module connection for a barge constructed with prefabricated SPS panels.

Once the side shell structures have been joined to the bottom structure, these barge hull sections 350,360 are joined together as illustrated in FIG. 6 using transverse welds between the SPS plates as illustrated in FIG. 12. The FIG. 12 joins incorporate two universal connectors 1000 between the inner or outer side shells or inner bottom hull or bottom hull. The welds between the universal connectors 1000 are finishing welds and those between universal connectors 1000 and SPS panels are shop joints. Thus the sections are joined along their entire cross-section which is not internal (i.e. hull bottom, outer side shell, sheerstrake, inner side shell, hopper and inner hull bottom). This results in good dimensional accuracy and ensures good fit between hull section modules. The construction is simple and the weld details are easy to comply with Class B fatigue designs.

Figure 13:
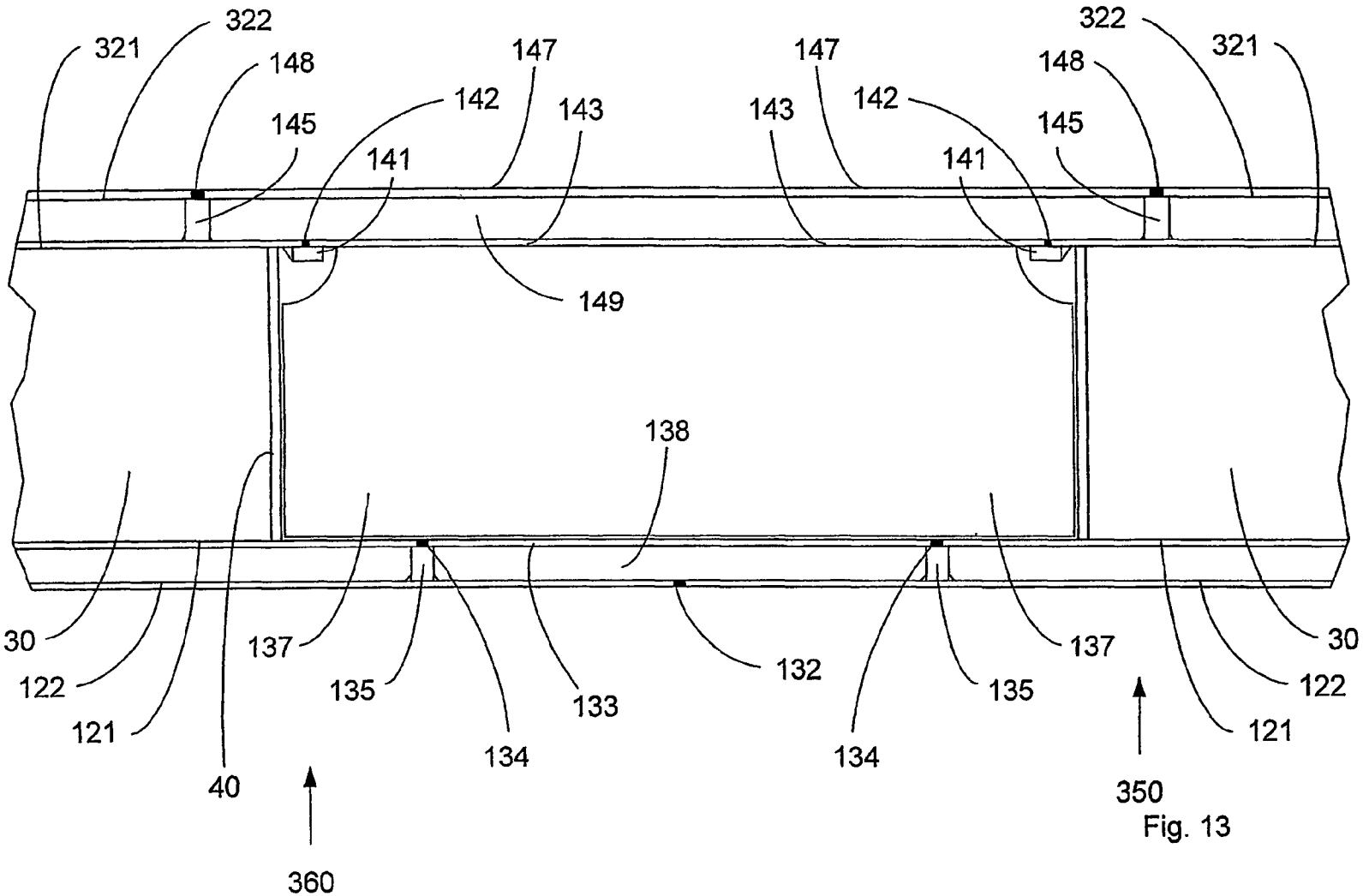
FIG. 13 is a hull module to hull module double bottom connection with closing segments that are made by injecting the elastomer on site after the cavities are welded closed.

FIG. 13 provides details of an alternative connection of hull modules to that illustrated in FIG. 12, particularly for the double bottom structure of the first, third and fourth embodiments. FIG. 13 illustrates how the inner bottom and outer bottom 22, 12 of individual hull sections 350,360 are attached. When the individual hull sections 350, 360 are assembled, the outer plate for second layer 122 of the outer bottom 12 is arranged to protrude at the end further than the other layers of the double bottom structure. During preparation of the hull sections 350, 360, end spacers 135 are welded between the inner (first) and outer (second) plates 121, 122 of the outer bottom 12 such that the end spacers 135 overlap the edge of the first layer 121 of the outer bottom 12. The outer (second)layers 122 of the outer bottom 12 are first joined with a seam weld 132. Once the seam weld 132 has been made, a first closing plate 133 is placed in the gap between the inner (first) layers 121 of the outer bottom sections and is supported by end spacers 135. A square grooved butt weld 134 then welds the first joining plate 133, the first layers 121 of the outer bottom 12 and the end spacers 135 together. In this way the outer bottom of adjoining hull modules are connected. The closed cavity 138 is injected with elastomer making the outer bottom composite and continuous.

Next a longitudinal girder portion 137 is welded into place (substantially half way across the beam of the hull) above the joined outer bottom 12. The longitudinal girder portion 137 is generally rectangular shaped, though the upper two corners are cut away to allow assembly of the inner bottom 22 as described below.

During the manufacture of the hull sections 350, 360 backing plates 141 are attached to the ends of the outside (first) plate 321 of the inner bottom 22. The next stage in the section joining method, after attaching the longitudinal girder portion 137, is to place a second joining plate 143 into the gap between the outside (first) plate 321 of the inner bottom 22, supported by the longitudinal girder 137 and the backing plates 141. Seam welds (square groove butt welds) 142 between the outer (first) layer 321 of the inner bottom 22, the second joining plate 143 and the backing plates fix the second joining plate 143 in place. The inner (second)

layer 322 of the inner bottom 22 is joined in a similar fashion to the way in which the inner (first) layer 121 of the inner bottom 12 is joined. This comprises end spacer elements 145 and square groove butt welds 148.

Once all the welding for the inner bottom is complete, the cavity 149 between the first and second layers is injected with elastomer to make the inner bottom composite and continuous. The process for filling the cavities is described in detail in applications related to the SPS structures referred to above and will not be described here. Composite intermediate layers may also be used.

Figure 15:
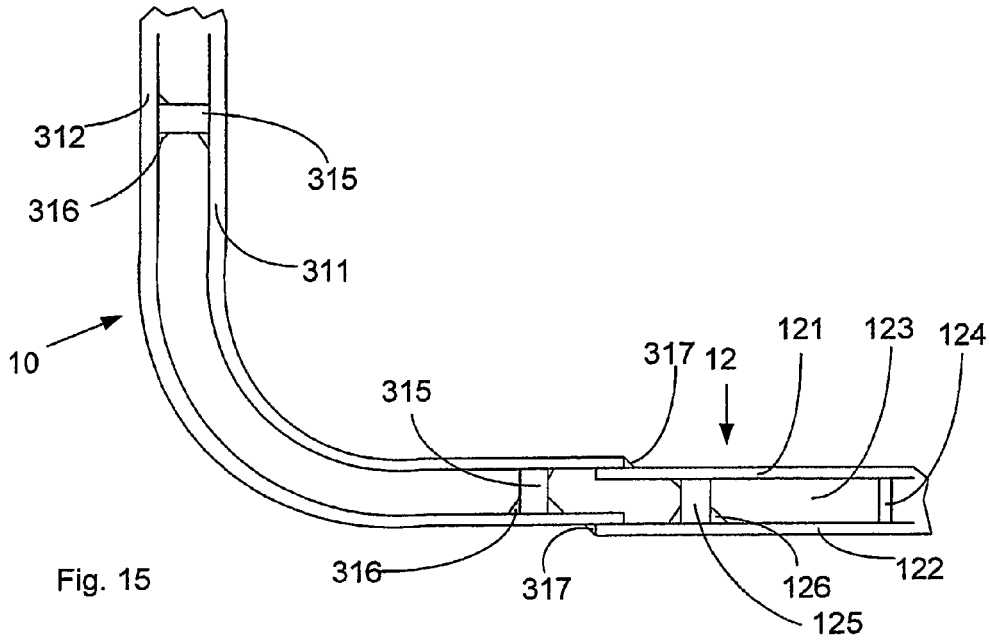
FIG. 15 is a transverse cross-section through the hull section shown in FIG. 2 showing the connection of the bottom outer hull wall to the side outer hull wall.
Figure 16:
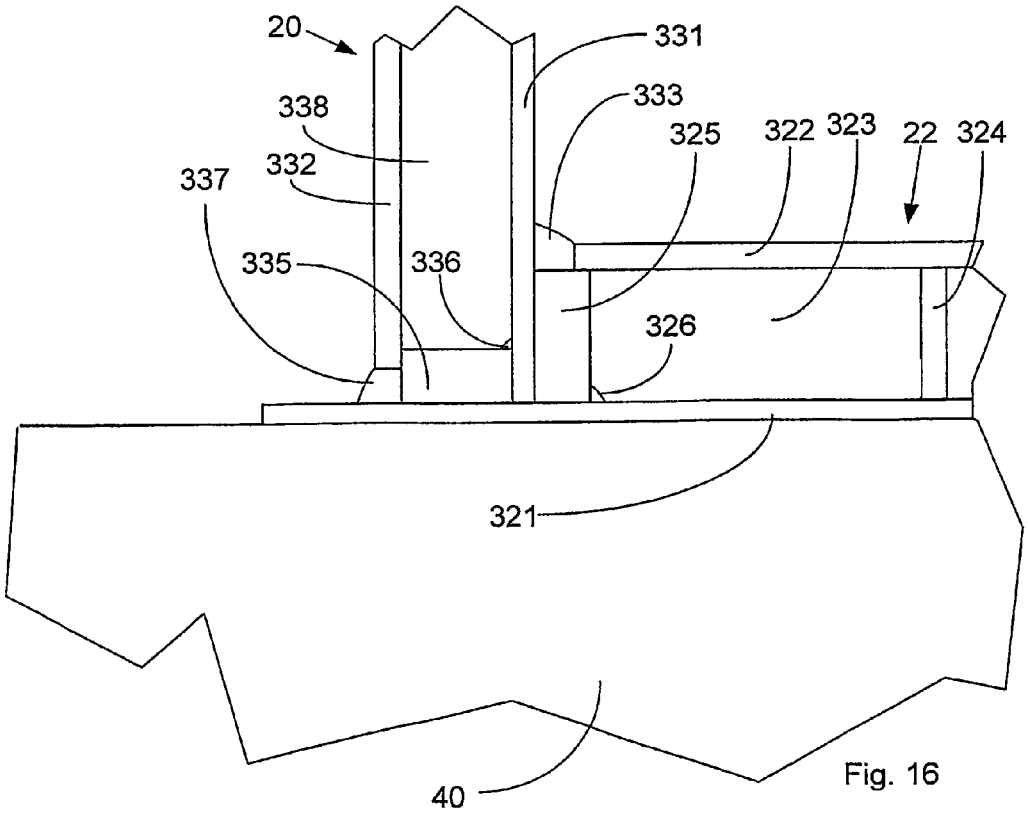
FIG. 16 is a transverse cross-section through the hull section shown in FIG. 2 illustrating the connection of the side and bottom inner hull walls.
Figure 17:
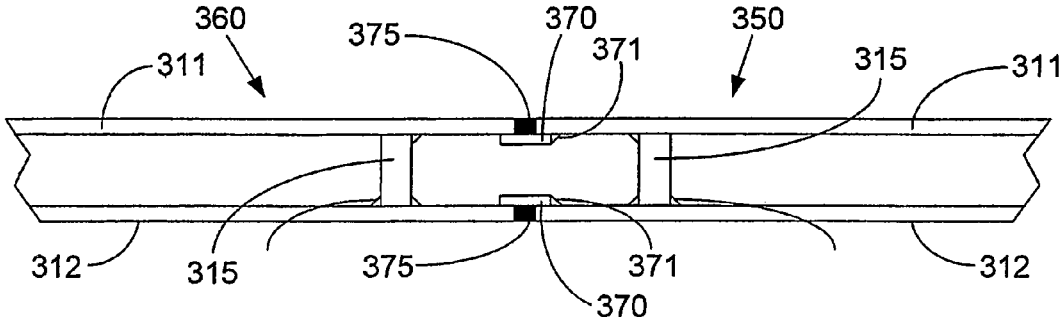
FIG. 17 is a longitudinal cross-section through the side outer hull walls of two joined hull sections of the first embodiment.

FIG. 14 illustrates the connection detail for joining SPS plating with steal plate. The steel plate may be rectangular or circular in plan and is fully bounded by the SPS plating. The main purpose is to provide a plate to which attachments can be welded or penetrations can be made (allows the passage of mechanical and electrical services) after the barge has been assembled. The site and location of these steel plates inserts are a function of the barge design;

FIGS. 15 to 17 illustrate alternative connection details which do not use universal connectors.

Part of the outer bottom hull wall 12 is shown in FIG. 15 in which the inner (first) layer 121 is attached in spaced apart relationship to the outer (second) layer 122. The two layers have a metal spacer 125 attached at their edge by welds 126 thereby to form a cavity 123 between the two layers. The metal spacer 125 is first attached to the outer (second) layer 122 with welds 126 on both sides of the metal spacer 125. The inner (first) layer 121 is then placed on top of the outer layer 122 and welded to spacer 125 on only one side of spacer 125 near the edge of the outer bottom 12. The spacer is only welded on one side to the inner layer 121 because only one side is accessible.

The longitudinal girder 30 and transverse girders 40 form a framework structure. These are assembled and attached together such that they are generally perpendicular to one another. Once that framework structure has been joined together and attached to the outer bottom 12, an inner (first) layer 321 of the inner bottom 22 may be attached to the framework structure by welds. This is illustrated in FIG. 16. Also illustrated in FIG. 16 is the attachment of a inner (second) layer 322 of the inner bottom 22 through a metal spacer 325. The metal spacer 325 is attached with a single longitudinal weld 326 to the outer (first) layer 321 of the inner bottom 22. Elastomer spacers 324 may also be placed between the two layers. Before welding, the inner layer of the side inner hull wall 20 is attached to the structure substantially perpendicular to the inner bottom 22. Then a large longitudinal weld 333 is used to connect both the inner (second) layer 322 of the inner bottom 22 to the spacer 325 and the outer (first) layer 331 of the inner side shell 20 to spacer 325.

A further spacer 335 is attached on the other side of the inner (first) layer 331 to spacer 325 via a longitudinal weld 336. An outer (second) layer 332 of the side inner hull wall 20 is then attached to further spacer 335 with a large longitudinal weld 337. In this way, a cavity 338 is formed between inner (first) layer 331 and outer (second) layer 332 of inner side shell 20.

Prefabricated web frame plate members 50 are then attached to the ends of the transverse girders 40 and the second layer 332 of the side inner hull wall 10 using welding.

The method for attaching the side outer hull wall 10 to the outer bottom hull wall 12 is illustrated in FIG. 17. An inner (first) layer 311 and outer (second) layer 312 of the outer hull side wall 10 are pre-bent such that they substantially form a right angle. A spacer 315 is then attached with welds 316 to the outer (second) layer 312 close to an end. The inner first layer 311 is then attached to the spacer 315 with a single weld. The outer side shell 10 is then attached to the outer bottom 12 by inserting inner (first) layer 121 of outer bottom 12 between inner (first) layer 311 and outer (second) layer 312 of outer side shell 10 and welding 317 the first layer 311 of outer side shell 10 at its end to the outer surface of outer (first) layer 121 of outer bottom 12. The outer (second) layer 122 of outer bottom 12 is welded 318 at its end to the outer surface of outer (second) layer 312 of side outer hull wall 10.

FIG. 17 also illustrates how hull sections might be attached, particularly for the side shells. Backing plates 370 are attached between the inner (first) layer 311 and the outer (second) layer 312 of one section 350 to the first and second layers 311, 312 with a single weld 371 overlapping an end of the layers 311, 312. The first layers 311 and second layers 312 of the sections 350, 360 are then aligned and a large weld 375 is used to fuse the respective backing plate 370 and the ends of the first layers 311 and the backing plate 370 and the respective backing plate 370 and the ends of the second layers 312 together.

Although different methods of construction have been described, the most preferred way is to use prefabricated SPS plates of as large a size as possible (up to 9 m×18 m in the shipyard or 3 m×9 m for transport) joined by universal joints. This reduces the number of finishing welds required. Finishing welds are more likely to be poorly made than shop welds.

Materials and General Structural Properties of SPS Structures

The first and second layers described above for use with any embodiment, are preferably structural steel, as mentioned above, though may also be aluminium, stainless steel or other structural alloys in applications where lightness, corrosion resistance toughness or other specific properties are essential. The metal should preferably have a minimum yield strength of 240 MPa and an elongation of at least 10%.

The first plates, second plates may be solid or perforated, may be plated or have any other surface preparation applied or may be comprised of different materials and have thicknesses varying from 0.5 mm to 25 mm. Desired surface treatments, e.g. for corrosion prevention or slip resistance, or decoration, etc., may be applied to one or both of the outer surfaces.

The elastomer should have a modulus of elasticity, E, of at least 250 MPa, preferably 275 MPa, at the maximum expected temperature in the environment in which the member is to be used which could be as high as 100° C. The elastomer should be between 5 and 1000 mm thick.

The ductility of the elastomer at the lowest operating temperature must be greater than that of the metal layers, which is about 10%. A preferred value for the ductility of the elastomer at lowest operating temperature is 50%. The thermal coefficient of the elastomer must also be sufficiently close to that of the steel so that temperature variation across the expected operating range, and during welding, does not cause delamination. The extent by which the thermal coefficients of the two materials can differ will depend in part on the elasticity of the elastomer but it is believed that the thermal expansion coefficient of the elastomer may be about 10 times that of the metal layers. The coefficient of thermal expansion may be controlled by the addition of fillers to the elastomer. If exposed to the elements (weather) then the elastomer should be formulated to be hydrolytically stable and resistant to ultraviolet degradation.

The preferred elastomer is a non-foamed elastomer, for example a polyurethane elastomer which comprises of a polyol (e.g. polyester or polyether) together with an isocyanate or a di-isocyanate, a chain extender and a filler. The filler is provided, as necessary, to reduce the thermal coefficient of the intermediate layer, reduce its cost and otherwise control the physical properties of the elastomer. Further additives; e.g. to alter mechanical properties or other characteristics (e.g. adhesion and water or oil resistance), and fire retardants may also be included.

Low density forms may also be placed between the layers to save weight and may be constructed of foam, wood or hollow light gauge metal sections. The preferred form is a polypropylene semi rigid foam with a density greater than 20 kg/m$^3$. The size, position, orientation and number of the lower density forms is a function of design to acquire a composite core SPS panel with the desired structural behaviour.

The bond strength between the elastomer and metal layers must be at least 0.5, preferably 6, MPa over the entire operating range. This is preferably achieved by the inherent adhesiveness of the elastomer to metal but additional bond agents may be provided.

Whilst an embodiment of the invention has been described above, it should be appreciated that this is illustrative and not intended to be limitative of the scope of the invention, as defined in the appended claims, in particular, the dimensions given are intended as guides and not to be prescriptive.

The invention claimed is:

1. A hull section with an outer hull and an inner hold comprising inner hull plating comprising an inner bottom defining a bottom of said hold and a lower inner side shell defining lower sides of said hold;

outer hull plating comprising an outer bottom defining a bottom of said outer hull and a lower outer side shell defining lower sides of said outer hull; and a plurality of transverse girders located, in a spaced apart relationship, transversely between the inner and outer bottoms, each of said plurality of transverse girders having two associated web frames located at each end of said transverse girders and between said lower side shells;

wherein said inner hull plating and said outer hull plating are each comprised of a first metal layer and a second layer and an intermediate layer of elastomer bonded to said first and second layers so as to transfer shear forces therebetween.

2. A hull section according to claim 1, further comprising inner and outer upper side shells attached opposite said bottom hull wall to said inner and outer lower side shells respectively.

3. A hull section according to claim 2, wherein said web frames extend between said inner and outer upper side shells and said upper side shells are comprised of a first metal layer and a second metal layer and an intermediate layer of elastomer bonded to said first and second layers so as to transfer shear forces therebetween.

4. A hull section according to claim 2, wherein an intermediate layer of elastomer is bonded to said inner and outer upper side shells so as to transfer shear forces therebetween.

5. A longitudinal barge hull section according to claim 1, further comprising a longitudinal girder located longitudinally between the outer bottom and the inner bottom, said longitudinal girder being positioned substantially in the centre of the beam of the hull.

6. A longitudinal barge hull section according to claim 1, wherein said plurality of transverse girders are located at least 1 m from each other.

7. A hull section with an outer hull and an inner hold; comprising:

a single bottom defining on a first side at least a part of the bottom of said outer hull and, on a second side, the bottom of said inner hold;

inner side shells defining side walls of said inner hold;

bottom outer side shells defining side walls of said outer hull and parts of the bottom of the outer hull not defined by said bottom hull wall; wherein said single bottom is comprised of a first layer, a second layer and an intermediate layer of elastomer bonded to said first and second layers so as to transfer shear forces therebetween such that said first layer defines at least a part of the bottom of said outer hull and said second layer defines said bottom of said inner hold.

8. A hull section according to claim 7, wherein said part of the bottom of said outer hull is substantially flat.

9. A hull section according to claim 7, wherein longitudinal edges of said bottom outer side shells and longitudinal edges of said inner side shells are attached adjacent longitudinal edges of said bottom.

10. A hull section according to claim 7, wherein the distance between said inner side shells and bottom outer side shells decreases as the distance from the bottom decreases.

11. A hull section according to claim 7, wherein said inner and bottom outer side shells each comprise a first layer, a second layer and an intermediate layer of an elastomer material bonded to said first and second layers so as to transfer shear forces therebetween.

12. A hull section according to claim 7, wherein the width of said at least part of the bottom of the outer hull is a constant fraction of the beam of the outer hull.

13. A hull section according to claim 7, wherein said inner hull side shells comprise an upper inner side shell and a hopper attached together.

14. A hull section according to claim 13, wherein said hopper is attached to said bottom at an angle of between 45° and 20°.

15. A hull section according to claim 7, wherein a plurality of web frame plate members are attached between said inner and outer side shells joining them together.

16. A hull section according to claim 15, wherein said plurality of web frame plate members are spaced apart along the longitudinal direction of the hull at least 1000 mm apart.

17. A longitudinal barge hull section according to claim 15, wherein plates are attached to form a sheerstrake between said web frame plate members and generally parallel to said bottom of said outer hull.

18. A longitudinal barge hull section according to claim 15, wherein web frame stiffeners are attached to said web frame plate members.

19. A longitudinal barge hull section according to claim 15, wherein said web frame plate members are provided with cut-outs.

20. A longitudinal barge hull section according to claim 7, wherein a gunwale is attached at the top of the hull.

21. A longitudinal barge hull section according to claim 20, wherein said gunwale overhangs said bottom of said hold.

22. A longitudinal barge hull section according to claim 7, further comprising a connecting member comprising:

an elongate metal body of substantially constant cross-section and having at least one tapered edge formed by first and second inclined surfaces, said inclined surfaces serving as landing surfaces and weld preparations.

23. A longitudinal barge hull section according to claim 7, wherein said first layer, said second layer and said intermediate layer are of a prefabricated panel.

24. A hull section according to claim 7, wherein the first and second layers arc metal.

25. A barge comprising a plurality of longitudinal barge hull sections according to claim 7 joined together.

* * * * *